United States Patent [19]

Kado

[11] 4,312,143

[45] Jan. 26, 1982

[54] CHUTE STRUCTURE OF SNOW PLOUGH

[75] Inventor: Tetsuro Kado, Niigata, Japan

[73] Assignee: Niigata Engineering Co., Ltd., Tokyo, Japan

[21] Appl. No.: 140,634

[22] Filed: Apr. 15, 1980

[51] Int. Cl.[3] ..... E01H 5/00

[52] U.S. Cl. ..... 37/43 R

[58] Field of Search ..... 37/43 R, 43 A, 43 B, 37/43 C, 43 D, 43 E, 53, 12, 19–27; 302/59–63, 9–10; 193/15, 30, 2 R, 2 A, 16, 25 C; 406/191, 158, 167

[56] References Cited

U.S. PATENT DOCUMENTS

| | | | |
|---|---|---|---|
| 3,075,813 | 1/1963 | Vohl | 302/61 |
| 3,088,779 | 5/1963 | Vachon | 37/43 R |
| 3,357,749 | 12/1967 | Seymour et al. | 37/43 R X |
| 3,698,576 | 10/1972 | Gillette | 302/60 X |
| 4,184,274 | 1/1980 | Vohl | 37/43 R |

FOREIGN PATENT DOCUMENTS

| | | | |
|---|---|---|---|
| 480612 | 1/1952 | Canada | 37/43 R |
| 2103203 | 8/1972 | Fed. Rep. of Germany | 37/43 E |

*Primary Examiner*—E. H. Eickholt

*Attorney, Agent, or Firm*—Sughrue, Mion, Zinn, Macpeak & Seas

[57] ABSTRACT

A snow-blowing chute apparatus of a snow-plough vehicle includes an arcuate stationary duct and at least one arcuate movable duct. These ducts have axial curvatures equal with each other. The movable duct is vertically movable to extend from said stationary duct in an operative state and is superimposed therewith during a non-operative state in response to the operation of a means for moving said movable duct.

7 Claims, 8 Drawing Figures

CHUTE STRUCTURE OF SNOW PLOUGH

BACKGROUND OF THE INVENTION

The present invention relates to an expandable chute structure for throwing snow away from the road, to be incorporated in a snow plough vehicle such as a snow loader.

According to the conventional snow loader, a snow discharge opening of the chute is positioned as high as possible, and the chute is slantingly oriented upwardly in order to effectively enlarge the flying distance of the snow. Further, the chute must provide excellent rectification of snow flow therein by reducing resistivity against snow piece flow, and provide excellent convergence thereof.

Generally, the external size of the vehicle is defined by laws, and regulations, so that the chute having a high positional discharge opening must be retractable. In this case, during the operative state, the chute is telescopically expanded in order to heighten the position of the discharge opening, to thereby enhance snow-removing efficiency, while during the non-operative state (for mere running of the vehicle in out of service) the chute is retracted to meet with the vehicle height laws. Such an expandable structure has an additional advantage since when the vehicle is run in the non-operative state, the retracted chute widens the field of front vision for the operator. In other words, if the chute is a stationary structure, the chute may interrupt the view of field.

One of the conventional chute structures incorporated in the snow loader is shown in FIGS. 1 to 3(*b*), wherein a frame 6 is disposed in front of an operator's room 5. Mounted on the frame 6 are an auger 2 for levelling the snow, a blade 3 and a blower 4. The frame is vertically movable in accordance with the snow fall level.

Thus, as shown in FIG. 2, when the loader is advanced frontwardly with the blade 3 in the descent position in the snow surface, the snow scratched up by the blade 3 is compressingly gathered at the central portion thereof by the rotation of spiral members fixedly secured to a rotary shaft through an arm (not shown). The compressingly gathered snow is urged into an inlet opening 4*a* of the blower 4 opened at the central position of the blade 3. Thereafter, the snow is sucked into a water-wheel type centrifugal blower 4, broken into snow pieces, and the pieces are upwardly blown from a discharge opening 4*b* (FIG. 3*a*). The upwardly directed snow pieces are then introduced into a chute apparatus 1 through a chute 7 having one end confronted with the discharge opening 4*b*. The discharge opening 4*b* can be offset from the opening of the chute 7 by rotating a blower casing about its axis as illustrated by a dotted chain line in FIG. 3*a*. In this case, the snow pieces are directly discharged toward the atmosphere without passing through the chute apparatus 1. That is, the snow pieces are directly discharged toward the one lateral side of the snow loader and the snow pieces are diffusingly discharged, since the snow pieces are not subject to rectification.

The chute apparatus 1 includes a first frusto-conical duct 9 fixedly mounted on a chute table 8, a second duct 10 having its shape the same as that of the duct 9 and telescopically mounted thereon, and a main duct 11 having an arcuate shape telescopically mounted on the second duct 10. The main duct 11 has its base portion connected to a hydraulic cylinder 13 permitting vertical movement thereof. The vertical movement is guided by a guiding means 12 secured to the chute table 8. Therefore, upon completion of the retraction of a cylinder rod of the hydraulic cylinder 13, a chute opening 11*a* is positioned at the lowermost position as shown in FIGS. 2 and 3*a*, wherein the ducts 10 and 11 are superimposed with the duct 9. On the other hand, upon completion of the expansion of the cylinder rod, the chute opening 11*a* is at the uppermost position as shown in FIG. 3*b*, wherein the ducts 9, 10 and 11 are longitudinally aligned with one another to provide a telescopically expanded state. The direction of the chute opening 11*a* can be changed in a horizontal plane by rotating the chute table 8 about its vertical axis.

According to the conventional expandable chute apparatus 1, the vertical position of the chute opening 11*a* can be maintained high during snow-blowing operation. However, it is difficult to provide excellent rectification efficiency of the snow stream. To be more specific, the snow stream may be stalled within the ducts, and the snow pieces may be diffused during snow-throwing operation.

This disadvantage is due to the structure of the ducts. That is, the snow stream is generally rectified by the arcuate snow path. According to the conventional structure, the snow stream is extremely decelerated at its upward path defined by the first and second ducts 9, 10 prior to the snow reaching the inlet opening of the arcuate main duct 11. The decelerated snow stream strikes the inner peripheral surface of the main duct 11. The resulting snow speed is insufficient to provide excellent rectification efficiency. Further, the arcuate length of the main duct 11 is insufficient to provide a desirable rectification efficiency of the snow stream.

In order to overcome these drawbacks, another proposal has been made, wherein the inclination of the main duct 11 is increased with respect to the vertical direction to laterally direct the snow path thus allowing an enlarged arcuate length of the main duct. However, with this structure, flow resistivity is increased thus decreasing the flow speed of the snow, which in turn degrades the rectification efficiency of the snow stream.

SUMMARY OF THE INVENTION

It is therefore an object of the present invention to overcome the above-mentioned drawbacks and to provide an improved expandable snow-chute apparatus, wherein rectification and convergence efficiency of the snow stream with the chute can be highly maintained.

Another object of this invention is to provide such expandable snow-chute apparatus capable of providing excellent operability for snow removing work.

Briefly, and in accordance with the present invention, each of the ducts is arcuately formed with the curvature of the ducts being equal with each other. When the chute is in the expanded state the central axes of these ducts are continuously aligned with each other. When the chute is in the retracted state, the ducts, other than the lowermost duct, are superimposed with the latter. Such duct movement is attained by providing expandable means, a link and a guiding means.

According to a first embodiment, the link has one end pivotably secured to a chute table and has the other end slidably engaged with a slot member secured to a movable duct. The slot member has one end slidably supported to a guide rod arcuately extending substantially in parallel with the duct. The expandable means is pivotably disposed between the chute table and the link. By the expansion and retraction of the expandable means, the link is pivotted to urge the slot member along an arcuate guide rod, to thus vertically move the movable duct.

According to the second embodiment, the expandable means is directly disposed between the movable duct and the chute table to vertically move the movable duct along the arcuate guide rod.

With these structures the height of the chute opening and arcuate length of the chute is controllable without degrading the rectification efficiency of the snow stream passing through the ducts.

DETAILED DESCRIPTION OF THE INVENTION

Figure 1:
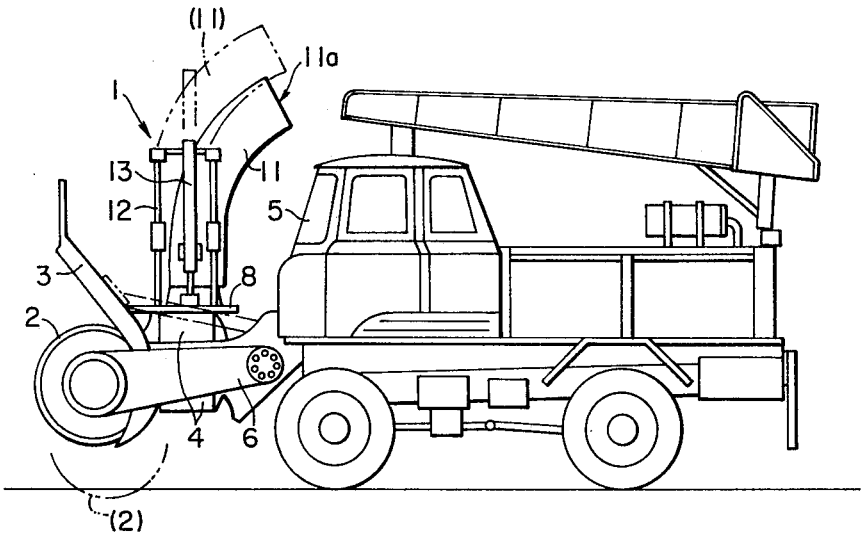
FIG. 1 PRIOR ART
FIG. 1 is a side view of a snow plough vehicle carrying a conventional expandable chute structure.
Figure 2:
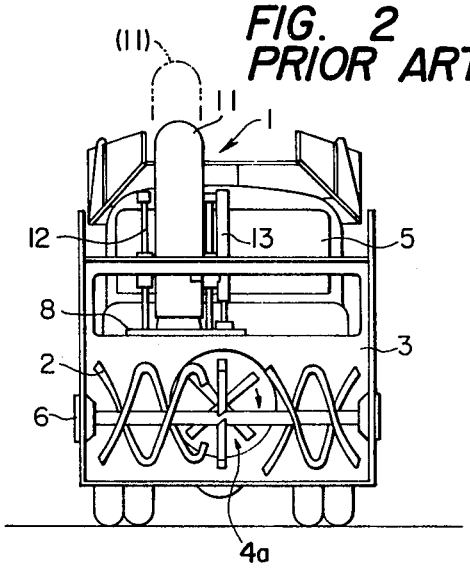
FIG. 2 PRIOR ART
FIG. 2 is a front view of FIG. 1.
Figure 3A:
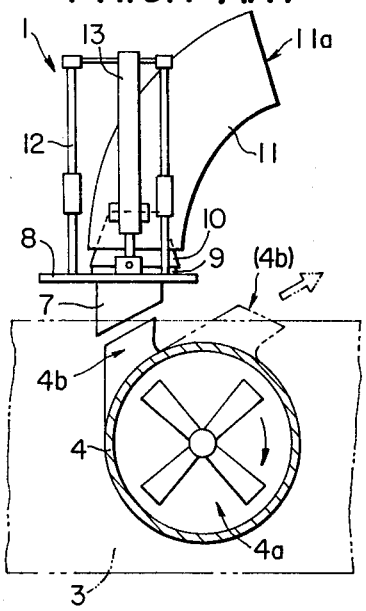
FIG. 3a PRIOR ART
FIG. 3*a* is a front view of the conventional chute apparatus showing its retracted state.
Figure 3B:
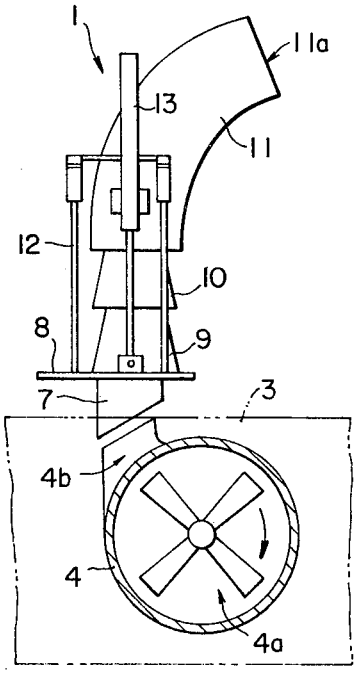
FIG. 3b PRIOR ART
FIG. 3*b* is a front view of the conventional chute apparatus showing its expanded state.
Figure 4:
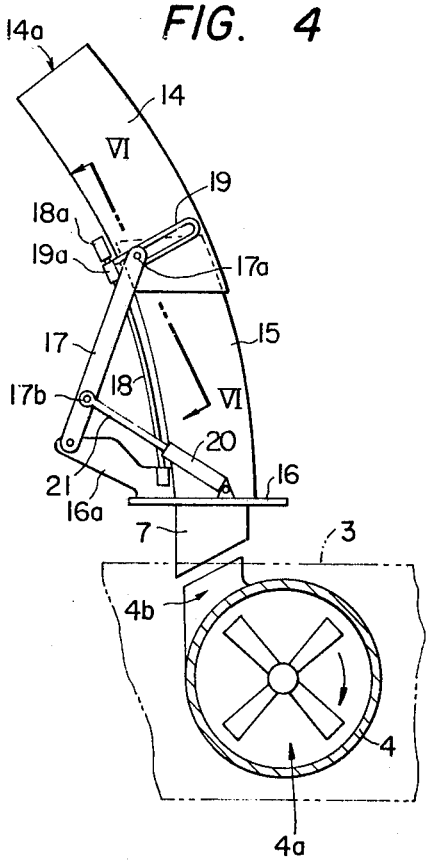
FIG. 4 is a front view of a snow-chute apparatus according to a first embodiment of the present invention showing its expanded state.
Figure 5:
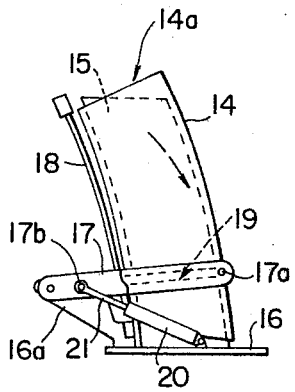
FIG. 5 is a front view of a snow-chute apparatus according to the first embodiment of the present invention showing its retracted state.
Figure 6:
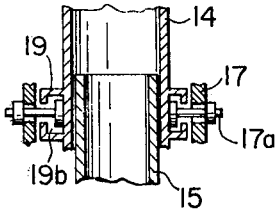
FIG. 6 is a cross-sectional view taken along the line VI—VI in FIG. 4.

A first embodiment according to the present invention is shown in FIGS. 4 through 6, wherein a chute comprises upper and lower ducts 14, 15. These ducts have a curvature equal with each other and have an arcuate length approximately equal with each other. The lower duct 15 is fixedly secured to a chute table 16. The chute table 16 is provided with a bracket 16*a* to which each one end of a pair of links 17 is pivotably secured. Further, a guide rod 18 is extended from the bracket 16*a* along the curvature of the duct. The arcuate guide rod 18 is positioned inside of the locus of the duct. That is, the rod is positioned nearer to the imaginary center of the duct locus than the duct.

At the diametrically opposite sides of the lower portion of the upper duct 14, a pair of slot members 19 are provided. One end of each of the slot members is slidably supported to the guide rod 18. The guide rod 18 has its free end provided with a stopper 18*a* adapted to prevent the slot members 19 from being disengaged from the guide rod 18.

Each of the slot members 19 is formed with a sliding groove 19*b* adapted to perform sliding engagement with a corresponding pin 17*a* extended from the other end of each of the links 17. Further, a hydraulic cylinder 20 is pivotably secured to the chute table 16. An operation rod 21 of the cylinder 20 is pivotably secured to a lower portion 17*b* of the link 17.

With the structure thus organized, the upper duct 14 is vertically movable in contact with the outer surface of the lower duct 15 along the guide rod 18 upon the slot members 19 being urged by the cylinder 20 via the links 17. For example, when the operation rod 21 of the cylinder 20 is at expanded state as shown in FIG. 4, the upper duct 14 is upwardly moved to provide an elongated arcuate snow path in order to carry out the snow blowing operation. On the other hand, in the non-service state of the chute apparatus for mere running of the snow plough vehicle, the operation rod 21 is retracted as shown in FIG. 5, so that the pin 17*a* of the link 17 is slidingly moved relative to the groove 19*b* of the slot member 19, to thereby lower the upper duct 14 along the guide rod 18. Upon completion of the retraction of the operation rod 21, the upper duct 14 is superimposed with the lower duct 15 to reduce the external dimension of the snow loader within the limited range defined by laws and regulations.

Figure 7:
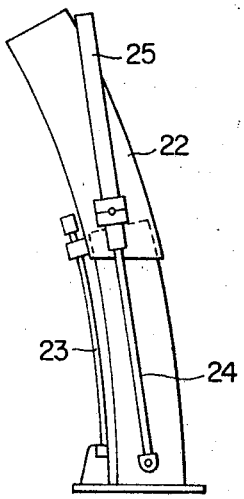
FIG. 7 is a front view of a snow-chute apparatus according to a second embodiment of the present invention.

The second embodiment of the present invention is shown in FIG. 7, wherein an upper duct 22 is directly slidingly guided by a guide rod 23. Further a hydraulic cylinder 25 is pivotably secured to the upper duct 22, and a tip end of an operation rod 24 of the cylinder 25 is pivotably secured to a stationary portion such as a lower duct. With this structure, the same function as that of the first embodiment is obtainable.

In view of the foregoing, according to the present invention, the entire snow path defined by the ducts defines a gentle arcuate shape, so that snow pieces are not subject to excessive resistance during their travel thus maintaining their blowing velocity. Further, because of relatively long arcuate path, the snow pieces are subject to excellent rectification.

What is claimed is:

1. In a chute apparatus for use in a snow plough vehicle including a stationary duct having one end in communication with a discharge opening of a blower, and at least one movable duct telescopically mounted on said stationary duct, said movable duct being slantingly oriented upwardly from the other end of said stationary duct in an operative state, and being superimposed with said stationary duct in a non-operative state to lower the position of a discharge opening of said movable duct, the improvement comprising:

(a) said stationary duct and said at least one movable duct having axial curvatures substantially equal with each other to provide arcuate ducts, (b) means for moving said at least one movable duct so as to axially aligh the same with said arcuate stationary duct during an operative state, and to superimpose said movable duct with said arcuate stationary duct during a non-operative state, said means for moving said movable duct comprising, (c) at least one link having one end pivotably secured to a stationary portion of said snow plough vehicle, (d) at least one slot member secured to a lower portion of said movable duct, said link having the other end in sliding engagement with said slot member, and (e) a hydraulic cylinder having one end pivotably secured to said stationary portion and the other end pivotably secured to said link.

2. The improvement of claim 1 wherein said stationary duct is fixedly mounted on a chute table positioned above said blower and in front of said snow plough vehicle.

3. The improvement of claim 1 wherein said other end of said link is provided with a pin adapted to be slidingly engaged with a groove defined by said slot member.

4. The improvement of claim 1, wherein said means for moving said movable duct further comprises a guide rod having a curvature substantially the same as the curvature of said ducts, said guide rod extending from said stationary portion, said slot member having one end slidingly engaged with said guide rod.

5. The improvement of claim 4 wherein said guide rod is positioned inside of an arcuate locus of said movable duct.

6. In a chute apparatus for use in a snow plough vehicle including a stationary duct having one end in communication with a discharge opening of a blower, and at least one movable duct telescopically mounted on said stationary duct, said movable duct being slantingly oriented upwardly from the other end of said stationary duct in an operative state, and being superimposed with said stationary duct in a non-operative state to lower the position of a discharge opening of said movable duct, the improvement comprising:

(a) said stationary duct and said at least one movable duct having axial curvatures substantially equal with each other to provide acruate ducts, (b) means for moving said at least one movable duct so as to axially align the same with said arcuate stationary duct during an operative state, and to superimpose said movable duct with said arcuate stationary duct during a non-operative state, said means for moving said movable duct comprising, (c) a hydraulic cylinder having one end pivotably secured to said stationary portion and the other end pivotably secured to said movable duct.

7. The improvement of claim 6, wherein said means for moving said movable duct further comprises a guide rod having a curvature substantially equal with the curvature of said ducts, said movable duct having a lower end slidingly engaged with said guide rod.

* * * * *